United States Patent [19]

Chaffee et al.

[11] 4,307,322

[45] Dec. 22, 1981

[54] COUPLED CAVITY TRAVELING WAVE TUBE HAVING IMPROVED LOSS STABILIZATION

[75] Inventors: Edwin G. Chaffee, Redwood City; Ronald W. Herriott, San Bruno, both of Calif.

[73] Assignee: Litton Systems, Inc., San Carlos, Calif.

[21] Appl. No.: 64,166

[22] Filed: Aug. 6, 1979

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,324,338 | 6/1967 | Winslow | 315/3.5 |
| 3,354,346 | 11/1967 | Lavik | 315/3.5 |
| 3,354,347 | 11/1967 | Hant | 315/3.5 |
| 3,602,766 | 8/1971 | Grant | 315/3.6 |
| 3,832,593 | 8/1974 | Gross | 315/3.5 |
| 4,066,927 | 1/1978 | Gross | 315/3.5 |

*Primary Examiner*—Saxfield Chatmon, Jr.
*Attorney, Agent, or Firm*—Gerald L. Cline; Donald J. Ellingsberg; Harold E. Gillmann

[57] ABSTRACT

A coupled cavity traveling wave tube is disclosed which includes a plurality of pole piece members and hollow spacer members which are alternately arrayed to define a plurality of cavities. The pole piece members each has a central aperture and a coupling slot through which microwave energy is coupled between adjacent cavities. The tube includes a plurality of first loss elements each of which is positioned in both of two respective adjacent cavities, with each of the first loss elements having its first end in contact with the front face of a respective one of the alternate pole piece members, its central portion pass through an aperture in the next intervening pole piece member in which it is coupled to the coupling slot in that pole piece member, and its second end in contact with the rear face of the next alternate pole piece member. The tube further includes a plurality of second loss elements each of which is positioned in both of two respective adjacent cavities, with each of the second loss elements having its first end in contact with the front face of a respective one of the intervening pole piece members, its central portion pass through an aperture in the next alternate pole piece member in which it is coupled to the coupling slot in that pole piece member, and its second end in contact with the rear face of the next intervening pole piece member.

17 Claims, 3 Drawing Figures

COUPLED CAVITY TRAVELING WAVE TUBE HAVING IMPROVED LOSS STABILIZATION

The present invention relates to traveling wave tubes, and more particularly to a manner for increasing the stability of coupled cavity traveling wave tubes by providing improved loss stabilization means for such traveling wave tubes.

BACKGROUND OF THE INVENTION

The traveling wave tube is a known type of electronic vacuum tube device which is widely used as a component of microwave electronic systems as an amplifier of microwave frequency electromagnetic waves. In the traveling wave tube, the microwave frequency electromagnetic wave is made to propagate along a slow wave structure of the device. The slow wave structure causes the microwave signal to traverse a greater length during the time that it is interacting with an electron beam in the tube than does the electron beam, so that the apparent or phase velocity of the electromagnetic wave appears to the electron beam to be substantially equal to the lower velocity of the electrons in the electron beam. Upon interaction between the electrons and the electromagnetic wave, energy is transferred from the electron beam to the electromagnetic wave, and the electromagnetic wave is thereby amplified.

The present invention is concerned with a type of traveling wave tube known as a coupled cavity traveling wave tube, in which the slow wave structure is formed from a plurality of cavities which are aligned along a common axis. The device also includes an equal plurality of apertures in the walls between adjacent ones of the cavities, with these apertures being aligned along the axis of the device. The electron beam is then projected along the axis of the device through these apertures. Typically, microwave coupling between the cavities is provided by coupling slots in the common walls between the adjacent cavities, with the coupling slots being alternately positioned above and below the apertures through which the electron beam passes. Typical coupled cavity traveling wave tubes are shown, for example, in U.S. Pat. No. 4,103,207 and in the various publications mentioned in that patent.

One of the desirable operating characteristics of a traveling wave tube is its extremely broad band width. Typical traveling wave tubes are capable of amplifying input microwave signals over a band width of an octave or more. However, this very strength of a traveling wave tube also sometimes becomes one of its weaknesses. Because the traveling wave tube does have a broad band width, spurious or undesirable signals are also sometimes developed within the traveling wave tube. The traveling wave tube cannot distinguish between a signal of a frequency within its operating band width which an operator wishes to have amplified and a signal of the same frequency which is present in the device which the operator does not wish to have amplified. The traveling wave tube thus proceeds to amplify both the desired input signal and the spurious signals generated within the traveling wave tube itself, but which are within the frequency range in which the traveling wave tube operates. The traveling wave tube thus has a tendency to go into oscillation at undesired frequencies within its operating band width.

One of the known ways of suppressing or preventing undesired oscillation in a traveling wave tube is to provide distributed loss elements along the slow wave structure of the traveling wave tube to stabilize against these oscillations. These distributed loss elements also provide gain equalization across the spectrum of the traveling wave tube to provide a desired gain vs. frequency characteristic of the traveling wave tube to compensate for any unequal gain characteristic which the traveling wave tube might otherwise have across its band width.

One technique which has been used to provide a distributed loss in a coupled cavity traveling wave tube is to position one or more cylinders of dielectric material along the length of the traveling wave tube, with a portion of the cylinders thus being in each of the coupled cavities. Lossy material is included in the cylinder to serve as the distributed loss along the length of the slow wave structure. One problem with this approach is that it results in essentially the same loss being inserted in each cavity, and it makes it difficient to vary the loss in the individual cavities if this is desired. In addition, as the lossy material absorbs microwave energy, it gets hotter, and in many such applications the cylinders are made hollow to allow a cooling fluid flowing within the dielectric cylinder. Thus, the ends of the dielectric cylinder must be taken outside of the vacuum envelope of the traveling wave tube in order to provide the cooling fluid. This requirement to bring cooling fluids within the vacuum envelope has limited the use of this technique to provide the desired distributed loss along the slow wave structure.

SUMMARY OF THE INVENTION

Briefly stated, and in accordance with the presently preferred embodiment of the invention, a coupled cavity traveling wave tube is provided which includes a plurality of pole piece members and hollow spacer members which are alternately arrayed to define a plurality of cavities. The pole piece members each has a central aperture, through which the electron beam is projected, and also each has a coupling slot through which microwave energy is coupled between adjacent cavities. In accordance with the present invention, a plurality of first loss elements is provided each of which is positioned in both of two respective adjacent cavities, with each of the first loss elements having its first end in contact with the front face of a respective one of alternate pole piece members, its central portion pass through an aperture in the next intervening pole piece member, in which it is coupled to the coupling slot in that pole piece member, and its second end in contact with the rear face of the next alternate pole piece member. A plurality of second loss elements is also provided, each of which is positioned in both of two respective adjacent cavities, with each of the second loss elements having its first end in contact with the front face of a respective one of the intervening pole piece members, its central portion pass through an aperture in the next alternate pole piece member, in which it is coupled to the coupling slot in that pole piece member, and its second end in contact with the rear face of the next intervening pole piece member.

BRIEF DESCRIPTION OF THE DRAWINGS

For a complete understanding of the invention, together with an appreciation of its objects and advantages, please refer to the following detailed description of the attached drawings, in which.

DESCRIPTION OF THE PREFERRED EMBODIMENT

Figure 1:
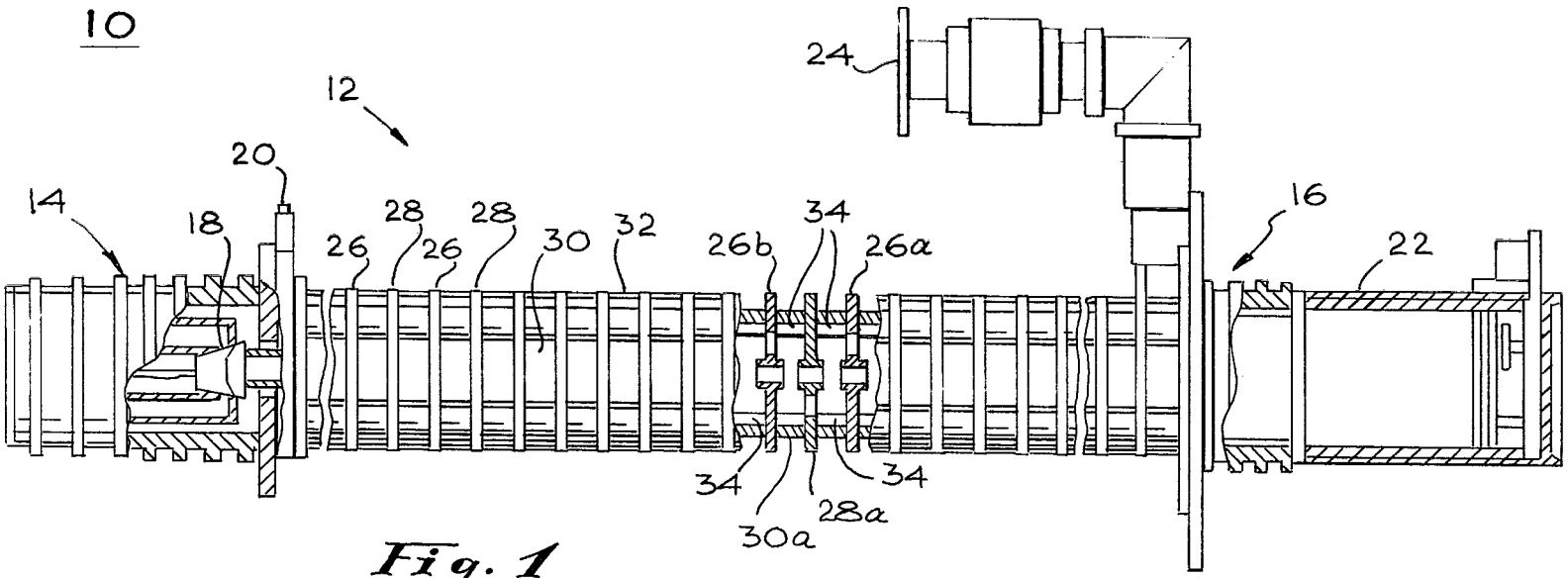
FIG. 1 is an overall view, partly broken away and with the broken away part in cross-section, illustrating a coupled cavity traveling wave tube according to the present invention.

FIG. 1 shows a coupled cavity traveling wave tube 10 which includes a slow wave structure section 12, which is shown broken away from the input section 14 and the output section 16 of the traveling wave tube 10, since the slow wave structure 12 may be of any desired length.

Briefly, the input section 14 includes an electron gun 18 of conventional design and an input coaxial transducer 20 (which could equally well be a waveguide input) which provides the input microwave signal to the traveling wave tube 10. The output section 16 includes a collector electrode 22 and a waveguide output 24, out of which the amplified electromagnetic wave is taken from the traveling wave tube 10. Since all of these components are conventional, and by themselves form no part of the present invention, no further description of these elements is given herein.

The slow wave structure 12, which may be generally like the slow wave structure shown in the above-mentioned U.S. Pat. No. 4,103,207, defines a plurality of axially aligned coupled cavities, with the cavities being formed by a plurality of pole piece members 26 and 28 (including the pole pieces **26*a* and 28*a*) and an equal plurality of hollow spacer members 30 (including the spacer member 30*a*). The pole piece members may be considered to be successive pole piece members, and may be arbitrarily designated alternate pole piece members 26 and intervening pole piece members 28, with the alternate pole piece members 26 being the "odd" numbers successive pole piece members, and the intervening pole piece members 28 being the "even" numbered successive pole piece members. These pole piece members 26 and 28, spacer members 30 and magnets 32 are stacked in the manner shown in the above-mentioned U.S. Pat. No. 4,103,207 to form the cavities in the slow wave structure 12**.

Figure 3:
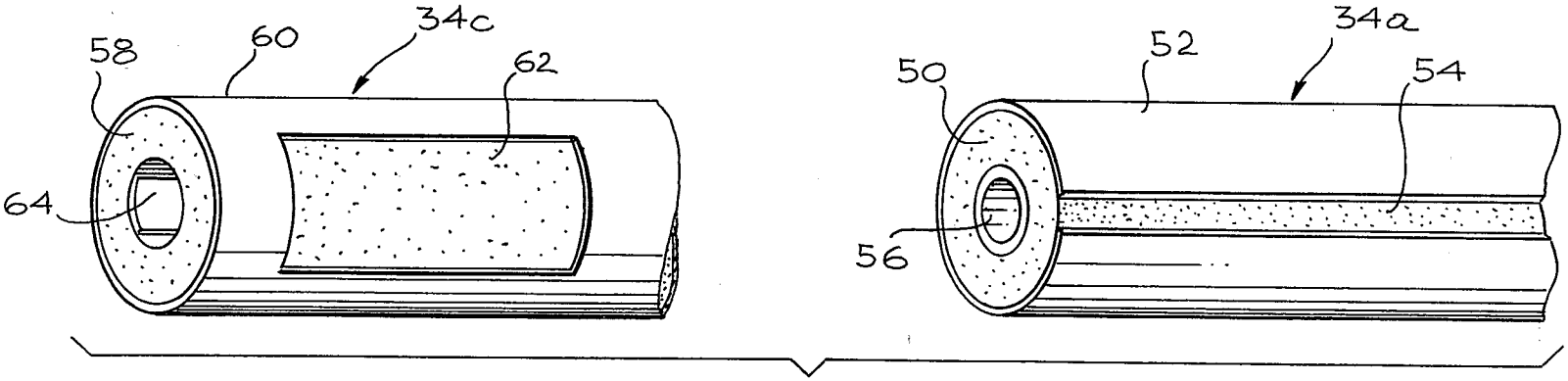
FIG. 3 is a perspective view of the loss elements of FIG. 2.

In FIG. 1, a portion of the slow wave structure 12 is shown broken away and in cross-section. This portion shows two of the alternate pole piece members **26*a* and 26*b*, one of the intervening pole piece members 28*a* and a spacer member 30*a*. The broken away section also shows the distributed loss elements 34 of the present invention, which are shown only schematically in FIG. 1. Details of the distributed loss elements 34 are shown in FIGS. 2 and 3**, which are now described.

Figure 2:
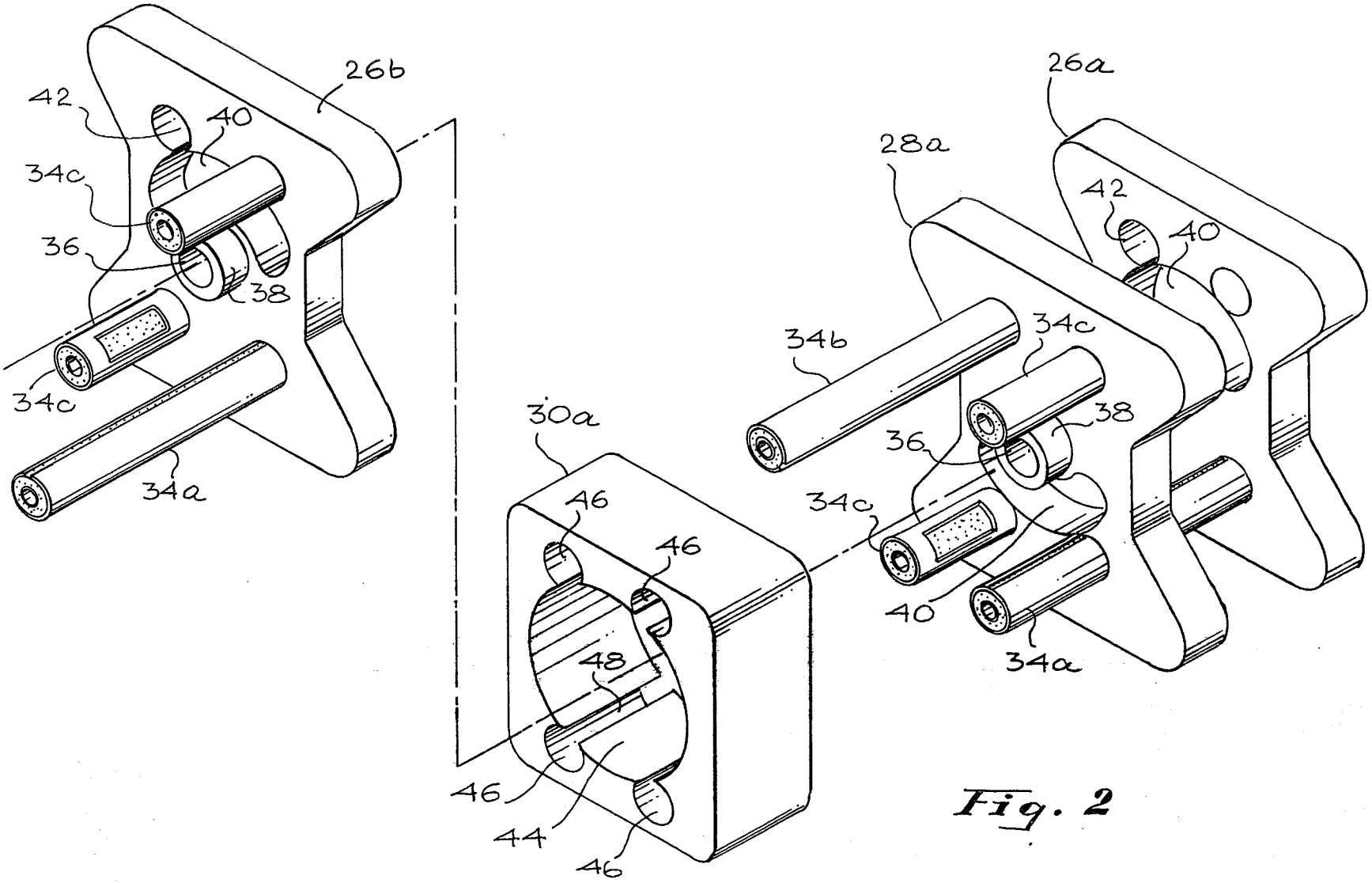
FIG. 2 is a perspective exploded view of the broken away portion of FIG. 1.

FIG. 2 is a perspective exploded view of the portion of the traveling wave tube 10 shown broken away in FIG. 1. In addition to showing details of the distributed loss elements 34, FIG. 2 also shows details of the manner in which adjacent cavities are coupled together, which are now described.

As is shown in FIG. 2, each of the pole piece members includes a central aperture 36 which is surrounded by a lip portion 38. When the traveling wave tube 10 is operated, the electron beam passes through the apertures 36 while traveling from the electron gun 18 to the collector electrode 22. Each of the pole piece members 26 and 28 also includes a kidney-shaped coupling slot 40 through which the electromagnetic wave is coupled between adjacent cavities. On the alternate pole piece members **26*a* and 26*b*, the coupling slot 40 is located above the central aperture 36, while on the intervening pole piece member 28*a* the coupling slot 40 is located below the central aperture 36, radially opposed to the position of the coupling slot on the alternate pole piece members 26*a* and 26*b***.

This radially opposed arrangement is used in many coupled cavity traveling wave tubes, and is used in the presently preferred embodiment of the invention. However, in some coupled cavity traveling wave tubes, the coupling slots are not so radially opposed to each other. The present invention is still useful in such devices. It is only necessary that the first and second loss elements **34*a* and 34*b* (described below) be located so that they are coupled to the coupling slot 40** in the pole piece member through which the loss element passes.

In accordance with the present invention, there is also provided a plurality of first loss elements **34*a*, each of which is positioned in both of two respective adjacent cavities, as is shown in FIG. 2. The first end of each of the loss elements 34*a* is in contact with the front face of one of the alternate pole piece members 26*a*. The central portion of each of the first loss elements 34*a* passes through an aperture in one of the intervening pole piece members 28*a*, and the second end of the first loss elements 34*a* is in contact with the rear face of the next alternate pole piece member 26*b*. Because of the exploded nature of FIG. 2, the next alternate pole piece member 26*b* is shown removed from the second end of the first loss element 34*a*, but when assembled, the free end of the first loss element 34*a* shown in FIG. 2 is in contact with the rear face of the next alternate pole piece member 26*b*. If desired, the ends of the loss elements can be secured to the faces of the pole piece members by any desired means, such as by brazing. However, this is not necessary, since the spacer member 30*a*** holds the loss elements in position, as is described below. It is only desirable that the ends of the loss elements be in good thermal contact with the faces of the pole piece members so that heat generated in the loss elements is dissipated out the pole piece members.

As is shown in FIG. 2, the first loss element **34*a* passes through an aperture in the intervening pole piece member 28*a* which is positioned in such a manner that the outer surface of the first loss element 34*a* is substantially tangent to the edge of the coupling slot 40. In some instances, however, it may be desirable to have the first loss element 34*a* actually extend somewhat into the coupling slot 40, while in other instances it may be desirable to have the first loss element 34*a* slightly removed from the coupling slot 40, in which case a coupling iris is cut between the coupling slot 40 and the aperture in the intervening pole piece 28*a* through which the first loss element 34*a* passes. It is only necessary that there be microwave coupling between the slot 40** and the loss elements.

A plurality of second loss elements **34*b*(only one of which is shown in FIG. 2) is also provided each of which is also positioned in both of two respective adjacent cavities, but which are staggered relative to the cavities through which the first loss elements 34*a* pass. As is shown in FIG. 2, the first end of each of the second loss elements 34*b* is in contact with the front face of a respective one of the intervening pole piece members, such as pole piece member 28***a*, and the central portion of each of the second loss elements 34*b* passes through an aperture 42 in the next alternate pole piece member 26*b*. The second end of the second loss elements 34*b* is then in contact with the rear face of the next intervening pole piece member 28 (which is not shown in FIG. 2).

FIG. 2 also shows a plurality of additional loss elements 34*c*, two of which are also positioned in each of the cavities, with each of these additional loss elements 34*c* having its first end in contact with the front face of one of the pole piece members, and its second end in contact with the rear face of the next pole piece members, regardless of whether the pole piece members are alternate or intervening members.

FIG. 2 also shows the spacer member 30*a*, which includes a relatively large central aperture 44 and four relatively smaller apertures 46, each of which is coupled to the central aperture 44 through an iris 48. The various loss elements 34*a*, 34*b* and 34*c* pass through the apertures 46 in the spacer member 30*a* which are aligned with the respective loss elements. When the various members are stacked and assembled, all of the first loss elements 34*a* are axially aligned with each other, all of the second loss elements 34*b* are axially aligned with each other, and the additional loss elements 34*c* in each cavity are axially aligned with the additional loss elements 34*c* in the other cavities, thereby defining four axially aligned arrays of loss elements distributed along the traveling wave tube. In the shown embodiment, the first loss elements 34*a* and the second loss elements 34*b* in each cavity are radially opposed to each other, and the additional loss elements 34*c* in each cavity are radially opposed to each other. In the presently preferred embodiment, the loss elements are so positioned that if lines are drawn between opposed pairs of the loss elements, these lines intersect at an angle of about 132°.

FIG. 3 shows a perspective view of one of the first loss elements 34*a* (which is identical to the second loss elements 34*b*) and one of the additional loss elements 34*c*. As is shown in FIG. 3, the first loss element 34*a* includes a hollow cylinder 50 formed from a dielectric material such as alumina. In the presently preferred embodiment of the invention, this cylinder 50 is surrounded by a thin metallic sleeve 52 which has a slot 54 running along its length, exposing the cylinder 50 thereunder so microwave energy may enter the loss element 34*a*. The interior surface of the dielectric cylinder 50 is coated with a layer 56 of lossy material, such as $SiC_4$. This results in a loss element having a relatively heavy loss and a relatively low Q. The length of one of the loss elements 34*a* is substantially equal to the sum of the length of two spacer members and one pole piece member.

The loss element 34*a* is positioned in the aperture in the intervening pole piece 28*a* in such a manner that the slot 54 is exposed to the coupling slot 40 in the intervening pole piece member 28*a*. This results in a structure which may be tuned by rotating the loss element 34*a*, thereby positioning the slot 54 at different positions relative to the coupling slot 40.

FIG. 3 also shows one of the additional loss elements 34*c*. The additional loss elements 34*c* include a hollow cylinder 58 of dielectric material, such as alumina, which is surrounded by a thin metallic sleeve 60 which has cut therein a rectangular aperture 62 so microwave energy may enter the loss element 34*c*. The loss is provided by an axial band of lossy material 64 positioned along the inner surface of the cylinder 58. This results in a loss element structure which has a very low loss and relatively high Q to obtain a sharp resonance, thereby allowing suppression of $2\pi$ mode oscillation in the traveling wave tube without inserting loss into the operating band width of the tube. The length of the loss element 34*c* is substantially equal to the length of one of the spacer members.

There is thus disclosed a novel coupled cavity traveling wave tube in accordance with the present invention which allows varying the loss characteristics in individual cavities to achieve a desired overall effect along the slow wave structure. In addition, any heat generated in the loss elements is efficiently removed through the pole piece members without introducing cooling fluid into the vacuum envelope of the tube.

While the invention is thus disclosed, and the presently preferred embodiment described in detail, the invention is not limited to this shown embodiment. Instead, many modifications will occur to those skilled in the art which still lie within the spirit and scope of the invention. For example, the thin metallic sleeves on the loss elements shown in FIG. 3 could be omitted if desired. Alternatively, the hollow cylindrical structure of the loss elements, with the lossy material coated on the inner surface of the cylinders, could be replaced with a solid cylindrical loss element made, for example, from a ceramic material such as MgO having therein a low percentage of $SiC_4$. It should also be noted that the loss elements need not extend the entire length of the tube.

As a still further example of a modification to the invention which is obvious to one of ordinary skill in the art, it may in some cases be desirable to remove the iris 48 in each of the two holes 46 of spacer 30*a* thru which the first loss element 34*a* and second loss element 34*b* pass. In such a configuration, the microwave energy to be absorbed is coupled into the first and second loss elements 34*a* and 34*b*, respectively, through each of the irises connecting the kidney shaped aperture 40 and hole 42 of pole piece 28*a* and 26*a* respectively. It is thus intended that the invention be limited in scope only by the appended claims.

What is claimed is:

1. In a coupled cavity traveling wave tube which includes a plurality of pole piece members and hollow spacer members which are alternately arrayed to define a plurality of cavities, the pole piece members each having a central aperture and a coupling slot through which microwave energy is coupled between adjacent cavities, the improvement comprising:

a plurality of first loss elements each of which is positioned in both of two respective adjacent cavities, with each of the first loss elements having its first end in contact with the front face of a respective one of the alternate pole piece members, its central portion pass through an aperture in the next intervening pole piece member in which it is coupled to the coupling slot in that pole piece member, and its second end in contact with the rear face of the next alternate pole piece member; and a plurality of second loss elements each of which is positioned in both of two respective adjacent cavities, with each of the second loss elements having its first end in contact with the front face of a respective one of the intervening pole piece members, its central portion pass through an aperture in the next alternate pole piece member in which it is coupled to the coupling slot in that pole piece member, and its second end in contact with the rear face of the next intervening pole piece member.

2. The invention of claim 1 which further comprises a plurality of additional loss elements each entirely positioned in a respective one of the cavities, with each of the additional loss elements having its first end in contact with the front face of a respective one of the pole piece members and its second end in contact with the rear face of the next pole piece member.

3. The invention of claim 2 in which there are two of the additional loss elements positioned in each of the cavities.

4. The invention of claim 3 in which the first loss elements are axially aligned with each other, the second loss elements are axially aligned with each other, and the additional loss elements in each cavity are axially aligned with the additional loss elements in the other cavities, thereby defining four axially aligned arrays of loss elements distributed along the tube.

5. The invention of claim 4 in which the alternate pole piece members each has a coupling slot therethrough on one side of its central aperture and the intervening pole piece members each as a coupling slot therethrough on the radially opposed side of its central aperture, and in which the first and second loss elements in each cavity are radially opposed to each other and in which the additional loss elements in each cavity are radially opposed to each other.

6. The invention of claim 5 in which each of the first and second loss elements is a lossy cylinder which has its outer surface substantially tangent to the coupling slot in the pole piece member through which its central portion passes.

7. The invention of claim 4 in which each of the loss elements is a hollow cylinder of dielectric material having a lossy material on its inner surface.

8. The invention of claim 7 in which the first and second loss elements have a relatively low Q lossy material on their inner surfaces and the additional loss elements have a relatively high Q lossy material on their inner surface.

9. The invention of claim 4 in which the first and second loss elements are each a cylindrical loss line segment having a sleeve of conductive material around its outer surface, with the sleeve having an axial slot along its length to allow microwave frequency energy to enter the loss line segment.

10. The invention of claim 4 in which the additional loss elements are each a cylindrical loss line segment having a sleeve of conductive material around its outer surface, with the sleeve having a rectangular aperture therein to allow microwave frequency energy to enter the loss line segment.

11. In a coupled cavity traveling wave tube which includes a plurality of pole piece members and spacer members which are alternately arrayed to define a plurality of cavities, the pole piece members each having a central aperture and a coupling slot through which microwave energy is coupled between adjacent cavities and the spacers each having a central opening, the improvement comprising:

a plurality of first loss elements each of which is positioned in both of two respective adjacent cavities, with each of the first loss elements having its first end in contact with the front face of a respective one of the alternate pole piece members, its central portion passing through an aperture in the next intervening pole piece member in which it is coupled to the coupling slot in that pole piece member, and its second end in contact with the rear face of the next alternate pole piece member, the plurality of first loss elements being distributed among the plurality of cavities such that at least one of the second loss elements is positioned within at least one of the cavities; and a plurality of second loss elements each of which is positioned in both of two respective adjacent cavities, with each of the second loss elements having its first end in contact with the front face of a respective one of the intervening pole piece members, its central portion passing through an aperture in the next alternate pole piece member in which it is coupled to the coupling slot in that pole piece member, and its second end in contact with the rear face of the next intervening pole piece member, the plurality of second loss elements being distributed among the plurality of cavities such that at least one of the second loss elements is positioned within at least one of the cavities.

12. The invention of claim 11 wherein the number of first loss elements is equal to the number of second loss elements within a respective cavity.

13. The invention of claim 11 in which each spacer member has, adjacent the central opening, at least a first aperture and a second aperture through which the at least first and second loss elements respectively pass.

14. The invention of claim 13 in which at least the first and second apertures are each coupled by a respective iris to the central opening.

15. The invention of claim 12 which further comprises a plurality of additional loss elements each entirely positioned in one of the cavities, with each of the additional loss elements having its first end in contact with the front face of one of the pole piece members and its second end in contact with the rear face of the next pole piece member, the plurality of additional loss elements being distributed among the plurality of cavities such that at least one of the additional loss elements is positioned within at least one of the cavities.

16. The invention of claim 15 in which, adjacent the central opening, each spacer member has at least first, second, and third apertures through which the at least first, second, and additional loss elements respectively pass, each aperture through which one of the additional loss elements pass being coupled to the central opening by a respective iris.

17. The invention of claim 16 in which each aperture through which one of the first or second loss elements pass is coupled by a respective iris to the central opening.

* * * * *